US006318229B1

(12) United States Patent
Nevels et al.

(10) Patent No.: US 6,318,229 B1
(45) Date of Patent: Nov. 20, 2001

(54) SYSTEM FOR BOOSTING VELOCITY OF A ROCKET

(76) Inventors: Joel P. Nevels; Margaret H. Nevels, both of 1480 La Paloma Dr., Carpinteria, CA (US) 93013

( * ) Notice: Subject to any disclaimer, the term of this patent is extended or adjusted under 35 U.S.C. 154(b) by 0 days.

(21) Appl. No.: 09/450,838

(22) Filed: Nov. 22, 1999

(51) Int. Cl.[7] ..... F41F 3/04
(52) U.S. Cl. ..... 89/1.816; 89/1.818; 89/1.81
(58) Field of Search ..... 89/1.8, 1.81, 1.82, 89/1.702, 1.703, 1.815, 1.816

(56) References Cited

U.S. PATENT DOCUMENTS

| | | | |
|---|---|---|---|
| 3,228,294 | * | 1/1966 | Hickman . |
| 3,363,508 | * | 1/1968 | Stahmer . |
| 3,425,316 | | 2/1969 | Egbert et al. . |
| 3,438,303 | | 4/1969 | Pesarini et al. . |
| 4,185,538 | | 1/1980 | Barakauskas . |
| 4,344,592 | | 8/1982 | Constantinescu . |
| 4,436,016 | * | 3/1984 | Olmstead et al. . |
| 4,643,072 | | 2/1987 | Hillebrecht . |
| 4,671,163 | | 6/1987 | Erikson . |
| 4,724,738 | * | 2/1988 | Johnson . |
| 4,796,510 | * | 1/1989 | Piesik . |
| 5,012,718 | * | 5/1991 | Miller . |
| 5,837,919 | * | 11/1998 | Yagla et al. . |
| 6,097,310 | * | 6/2000 | Yagla et al. . |

FOREIGN PATENT DOCUMENTS

| | | | |
|---|---|---|---|
| 2260078 | * | 8/1975 | (FR) . |

* cited by examiner

*Primary Examiner*—Charles T. Jordan
*Assistant Examiner*—Troy Chambers
(74) *Attorney, Agent, or Firm*—Theodore J. Bielen, Jr.

(57) ABSTRACT

A system for boosting the velocity of a rocket utilizing a container having a bottom and a side wall portion extending outwardly from the bottom. The side portion terminates in a peripheral edge and forms a chamber. A platform is supported in the chamber and is movable from a first position to a second position adjacent the peripheral edge of the side wall portion of the container. Exhaust gases are conducted to the chamber such that movement of the platform within the container supporting the rocket takes place.

14 Claims, 6 Drawing Sheets

SYSTEM FOR BOOSTING VELOCITY OF A ROCKET

BACKGROUND OF THE INVENTION

Rockets of a large size burn a tremendous amount of fuel after ignition or light-off in order to merely lift the rocket from a launching pad or platform. In certain cases, 24,000 pounds of fuel are burned every second. Simply eliminating two seconds of burn to propel a rocket into space would represent a tremendous savings in fuel. Such savings would translate into a decrease in the expense of such fuel and the addition of payload to the rocket structure.

U.S. Pat. Nos. 3,425,316 and 4,643,072 show submarine ejection systems in which compressed gases are used to force a rocket from a tube.

U.S. Pat. Nos. 4,185,538 and 4,671,163 describe tube launched missiles in which gases from a compressor or generated by combustion are used to force the missile to a launched condition.

U.S. Pat. No. 3,438,303 shows a system of launching a missile in which an outer auxiliary charge is provided.

U.S. Pat. No. 4,344,592 employs a launching tower in which an auxiliary liquid-propellant motor is used to move a piston, which pushes a rocket through the bore of the tower until the rocket is able to fire its own motors while in motion.

A system for launching rockets which utilizes the waste gas energy generated during ignition, to propel the rocket would be a notable advance in the aeronautical field.

BRIEF SUMMARY OF THE INVENTION

The present invention relates to a system for imparting velocity to a rocket during its initial firing.

The system of the present invention utilizes a container having a bottom and a side wall portion extending outwardly from the bottom. The side wall portion terminates in a peripheral edge. The bottom and side wall portion form a chamber having an opening formed at the peripheral edge. The container may be of any size commensurate with the rocket being launched in conjunction with the system of the present invention.

A platform is also employed in the present invention and includes a first surface for supporting the rocket and a second surface which faces a chamber of the container. The platform is movable along the container side wall portion between the bottom of the container and the peripheral edge of the side wall portion of the container. The platform is initially held by support means at a predetermined level above the bottom of the container. In certain instances the support means may take the form of the rim portion. In other instances, a separate support mechanism may be employed for the platform. Moreover, the rim portions may telescope from the bottom portion of the container. One section of the telescoping rim portion includes the platform which supports the rocket.

Conduit means is also found in the present invention for directing exhaust material from the rocket to the chamber of the container between the second surface of the platform and the bottom of the container. Such exhaust material creates a fluid pressure on the platform second surface to urge the platform away from the bottom, as well as the rocket supported thereupon. A stop limits the travel of the platform relative to the peripheral edge of the container. That is to say, the stop prevents the platform from leaving the chamber of the container. Conduit means may also be formed of a housing connected to the platform. The housing may include at least one opening which communicates with the exhaust material of the rocket. At least one door in the housing opens under pressure from the exhaust material to permit the exhaust material of the rocket to enter the chamber of the container.

In one embodiment of the invention the fluid located in the chamber may be in the form of a liquid, such as water. The rocket exhaust gases entering the chamber would heat the liquid to produce steam which, in turn, exerts a pressure on the second surface of the platform raising it relative to the bottom of the container. The liquid entering the chamber may be preheated by an auxiliary heating unit to permit the more rapid formation of steam when needed to launch a particular rocket. In addition, a heat source, separate from the rocket exhaust, may also be employed to elevate the temperature of the liquid in the chamber.

Vent means is also found in the present invention for relieving the fluid pressure within the chamber and from the second surface of the platform. Such a vent means may take the form of relief valves, or fixed vent openings through the side wall of the chamber at a level which would allow confinement of the liquid to the chamber of the container. Thus, such vent means relieves fluid pressure from the chamber such that the rocket supported by the platform is able to move from the bottom of the chamber to its outer most position during a period of time which the rocket requires to generate sufficient power to depart from the platform. Of course, a rate of venting and, consequently, the rate of lifting of the platform may be easily precalculated.

It may be apparent that a novel and useful system for imparting velocity to a launching rocket has been herein described.

It is therefore an object of the present invention to provide a system for boosting the velocity of a rocket which recovers the normally wasted exhaust gases generated by a rocket during its initial firing.

Another object of the present invention is to provide a system for boosting the velocity of a rocket to increase the range or payload of the rocket through the recovery of normally wasted exhaust gases.

A further object of the present invention is to provide a system for boosting the velocity of a rocket which conserves the fuel needed to launch the rocket, thus, saving a substantial amount of weight and reducing the cost of launching a particular rocket.

Another object of the present invention is to provide a system for increasing the velocity of the rocket which utilizes a container that adds a degree of safety to the launching of a rocket.

The invention possesses other objects and advantages especially as concerns particular characteristics and features thereof which will become apparent as the specification continues.

Reference is made to the following detailed drawings representing an aspect of the invention.

Figure 1:
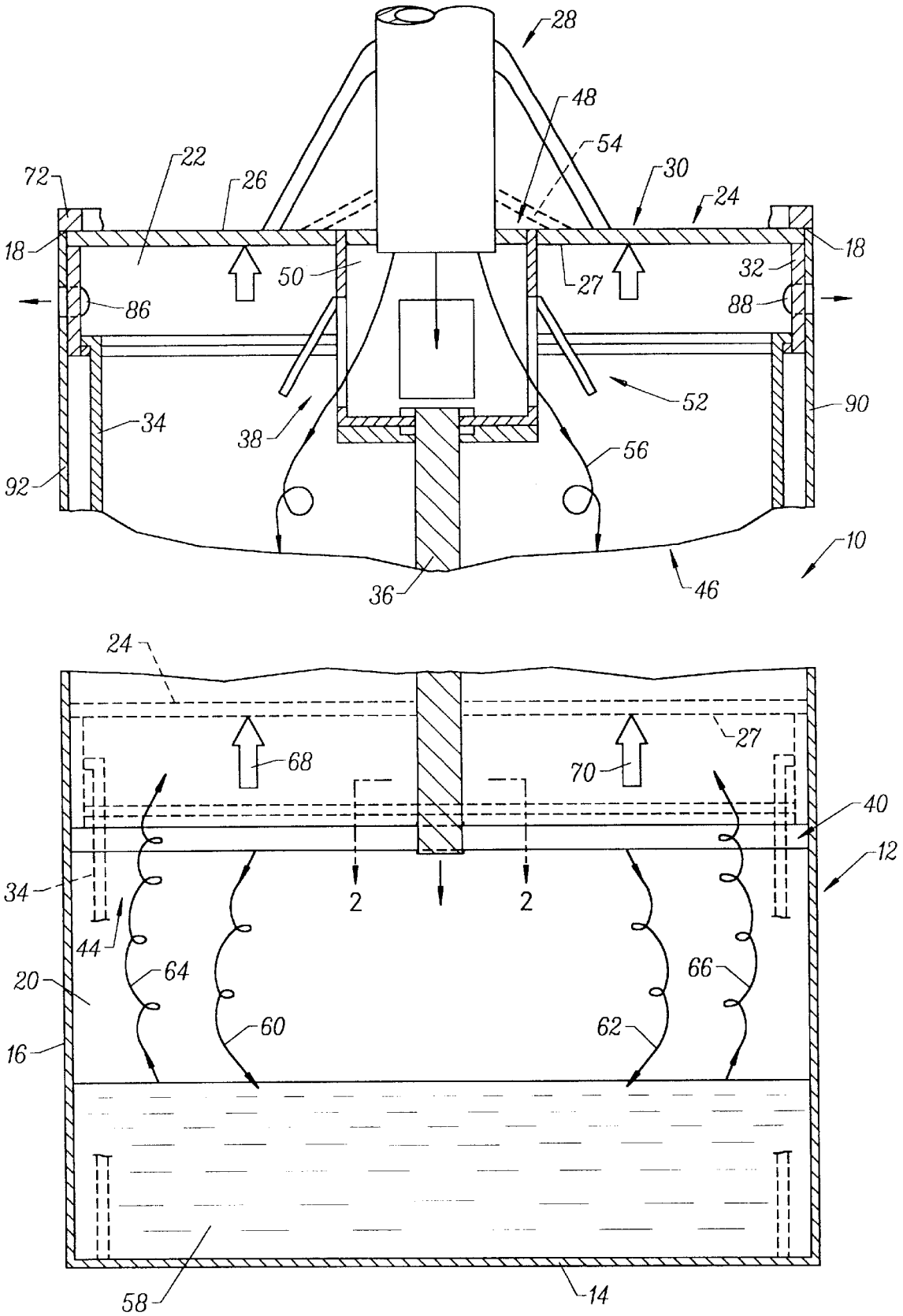
FIG. 1 is a sectional view of the system of the present invention for launching a rocket.

For a better understanding of the invention reference is made to the following detailed description of the preferred embodiments thereof which should be referenced to the prior described drawings.

DETAILED DESCRIPTION OF THE PREFERRED EMBODIMENTS OF THE INVENTION

Various aspects of the present invention will evolve from the following description of the preferred embodiments thereof which should be taken in conjunction with the hereinabove described drawings.

The invention as a whole is depicted in the drawings by reference character 10. System 10 includes as one of its elements a container 12 having a bottom 14, and a side wall portion 16 ending in a peripheral edge 18 which, in the normal orientation, lies at the top of container 12. Chamber 20 is formed within container 12 having an opening 22 surrounded by peripheral edge 18 of side wall 16. Container 12 may be of any size and is preferably constructed of sturdy material such as metal, composites, reinforced concrete, and the like.

Figure 2:
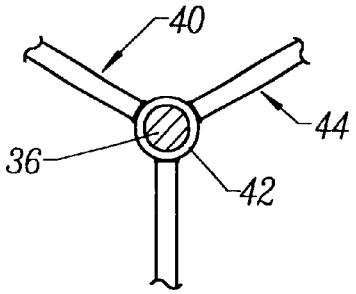
FIG. 2 is a sectional view taken along line 2—2 of FIG. 1.

A platform 24 is also included in the system of the present invention. Platform 24 includes a first surface 26 and a second opposite surface 27 which faces chamber 20 of container 12. First surface 26 of platform 24 supports a rocket 28, depicted in part in the drawings. Platform 24 is movable along side wall portion 16 of container 12 between bottom 14 and peripheral edge 18, thereof. Platform 26 may be a single entity or may be formed into multiple portions which are telescopically related to one another. As depicted in FIG. 1, platform 24 includes an upper portion 30 having a distending rim 32. Rim 32 is telescopically movable relative to upright 34. Upright 34 is intended to rest on bottom 14 of container 12 within chamber 20. It should be noted that platform portion 30 is depicted as being fully extended relative to upright 34, in the upper portion of FIG. 1 and partially extended from upright 34 in phantom in the lower portion of FIG. 1. Further support may be obtained by the use of column support 36 which connects to housing 38, the purpose which will be discussed hereinafter. Spider support 40, FIG. 2, guides column support 36 upwardly and downwardly relative to bottom 14 with the movement of platform 24. Ring 42 permits the sliding of column 36 relative to plurality of arms 44 of spider support 40. Spider support 40 arms 44 are depicted as being fixed to side wall portion of container 12. However, arm 44 may rest on bottom 14 of container 12, in tripod fashion. Thus, upright 34 and/or column 36 serves as support means 46 for holding platform 24 at a predetermined level above the bottom 14 of container 12.

Conduit means 48 is also illustrated in the drawings for directing exhaust material from rocket 28 to chamber 20 of container 12. Conduit means 48 may simply take the form of an opening 50 into chamber 20 through the platform 24. However, in the embodiment depicted in FIG. 1, conduit means 48 includes a housing 38 which distends and is held to platform 24. In such case, spider support 40 guides column 36 downwardly to bottom 14 of container 12 and serves as support means 46 for platform 24 above bottom 14 of container 12. Housing 38 includes a plurality of doors 52 which are hingedly attached to housing 38 and open when exhaust gases exit rocket 28. Rocket 28 may be shielded or sealed relative to opening 50 by a shroud 54 to insure that all the exhaust material exiting rocket 28 is directed into housing 38 and, eventually, into chamber 20. Directional arrows 56 show the downward movement of exhaust gases from rocket 28 within chamber 20.

Fluid body 58 may be placed within container 12. Fluid body 58 may simply be water or other fluid capable of generating steam. Directional arrows 60 and 62 depict the movement of exhaust gases from rocket 28 onto fluid body 58. Steam is generated from fluid body 58 and is depicted as moving upwardly from bottom 14 by directional arrow 64 and 66. Force arrows 68 and 70 show the action of the fluid pressure on second surface 27, exhibited by the steam emanating from fluid body 58 upon its heating by the exhaust gas from rocket 28. Platform 24 is thus moved upwardly or outwardly from bottom 14 and travels to the vicinity of peripheral edge 18 of container 12. A stop 72 prevents platform 24 from traveling beyond peripheral edge 18 of container 12.

Figure 3:
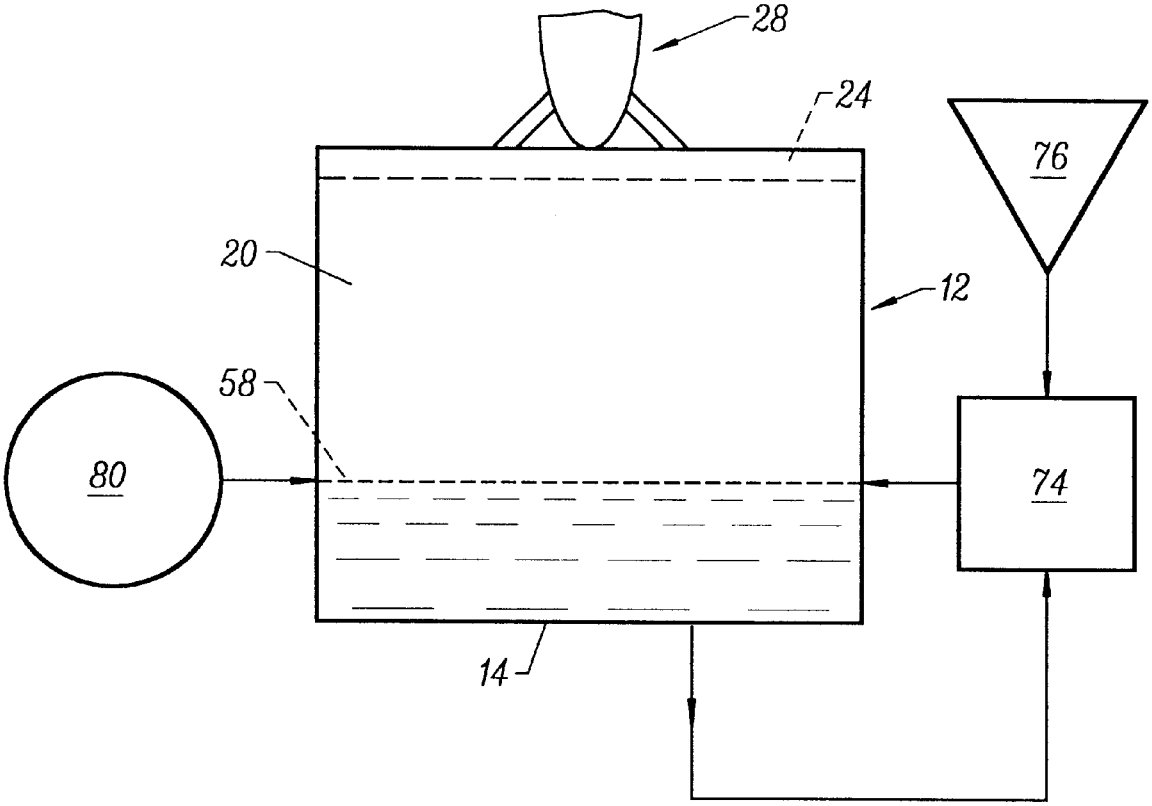
FIG. 3 is a schematic rendition of the system of the present invention utilizing auxiliary fluid pressure generating devices.

Turning to FIG. 3, it may be observed that system 10 may include additional features to aid in the movement of platform 24, supporting rocket 28 at its upward position from bottom 14 of container 12. For example, preheater 74 for fluid body 58 may be employed, obtaining heat from auxiliary heat source 76 such as a boiler. In addition, direct source of heat 80, such as an auxiliary rocket engine may also be used to directly inject heat into chamber 20 of container 12. In either case, the need for preheater 74 and auxiliary heat source 80 may be precalculated commensurate with the volume of fluid body 58, the weight of rocket 28, the size of container 12, and the like.

Figure 4:
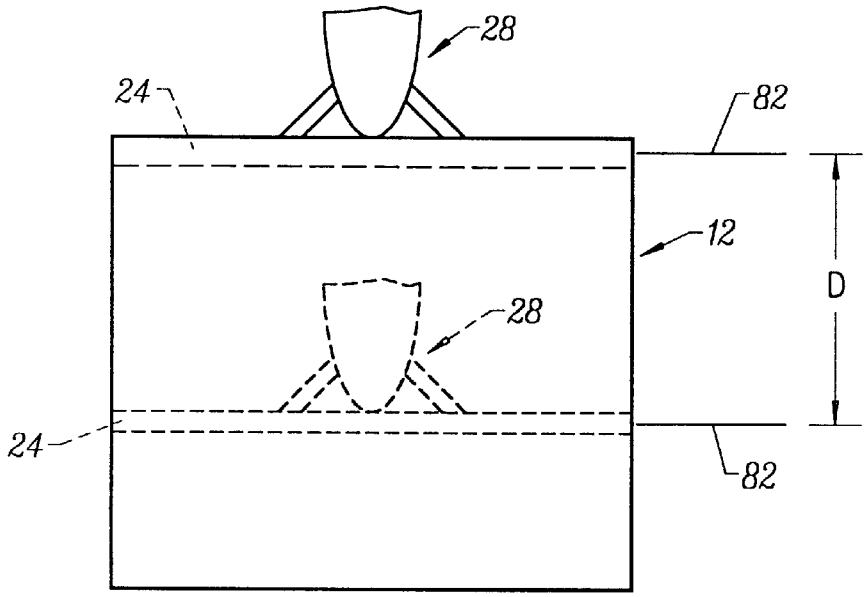
FIG. 4 is a schematic rendition of the system of the present invention depicting the movement of the platform within the container.

In a basic schematic format, FIG. 4, it may be observed that platform 24, in essence moves from a level 82 to a level 84 and travels a distance, D, due to the capture of exhaust gases from rocket 28. Such distance, D, may be travelled within a matter of seconds. In any case, rocket 28 possesses a velocity greater than zero at level 84, at which time the engines of rocket 28 should be able to move rocket 28 from the top of platform 28 and into flight.

Relief valves 86 and 88 may be employed to control the movement of platform 24, again, to precisely time the lift-off of rocket 28 of platform 24. Also, grates or slits 90 and 92 may also be employed to this end for control of the rate of rise or fall of platform 24.

Figure 5:
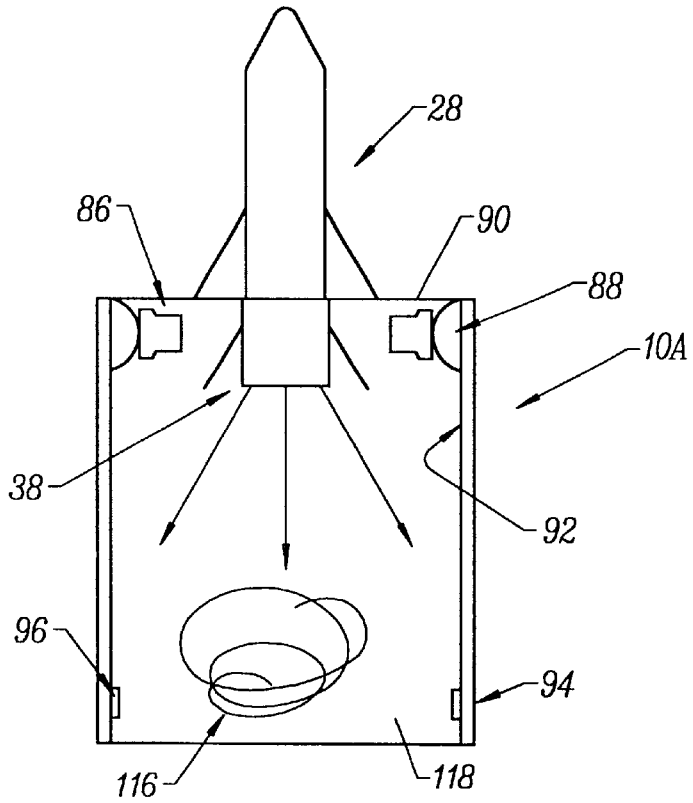
FIG. 5 is a schematic rendition of another embodiment of the system of the present invention depicting the initial firing of a rocket.
Figure 6:
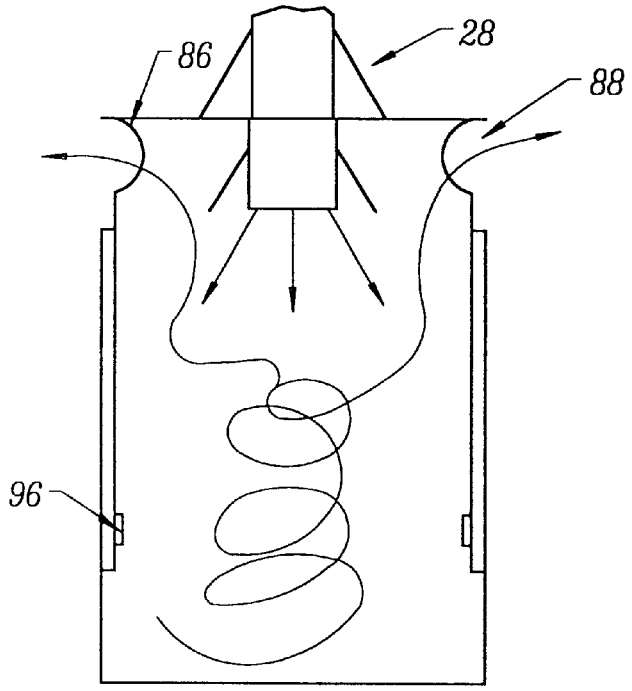
FIG. 6 is a schematic rendition of the embodiment of FIG. 5 in which the rocket has moved upwardly and the relief valves have begun to activate.
Figure 7:
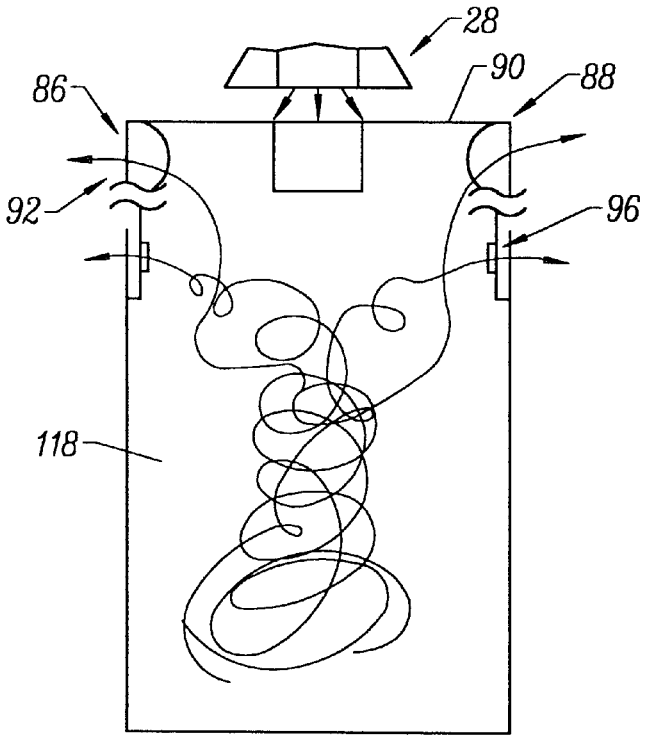
FIG. 7 is a schematic view of the system of FIG. 5 in which the rocket carrying platform, broken, has extended upwardly to the point where additional movement of the rocket carrying platform has taken place and pressure release vents have been activated.
Figure 8:
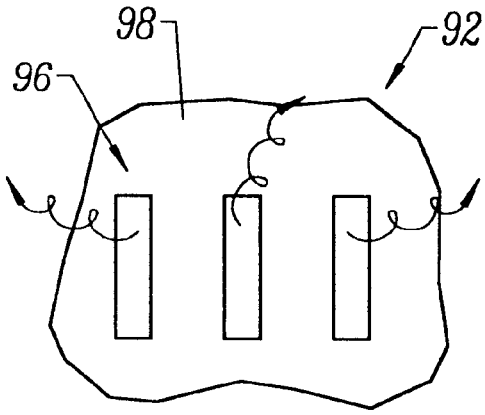
FIG. 8 is a partial side elevational view of the vents found in FIGS. 5–7.

Viewing now FIGS. 5–7, another embodiment 10A of the system of the present invention is shown schematically.

Rocket 28 is diagramed as supported on a platform 90 which is a portion of a skirt 92 that fits within a container 94. Skirt 92 includes relief valves 86 and 88, as shown in the prior embodiment 10. However, a plurality of vents 96 are located on the outer surface 98 of skirt 92. Vents 96 permit additional release of the pressure built within the embodiment 10A of the system of the present invention, which will be discussed hereinafter in greater detail.

Figure 9:
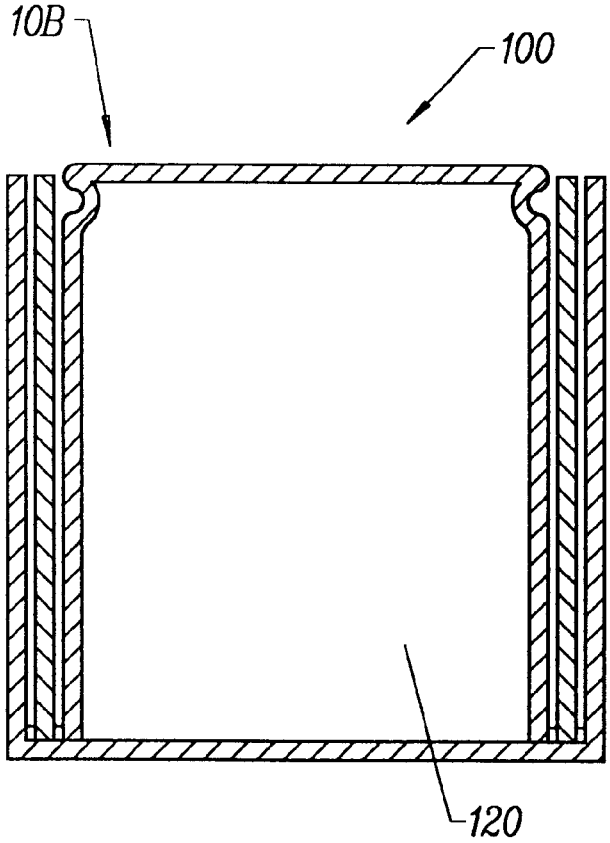
FIG. 9 is a sectional view showing yet another embodiment of the system of the present invention.
Figure 10:
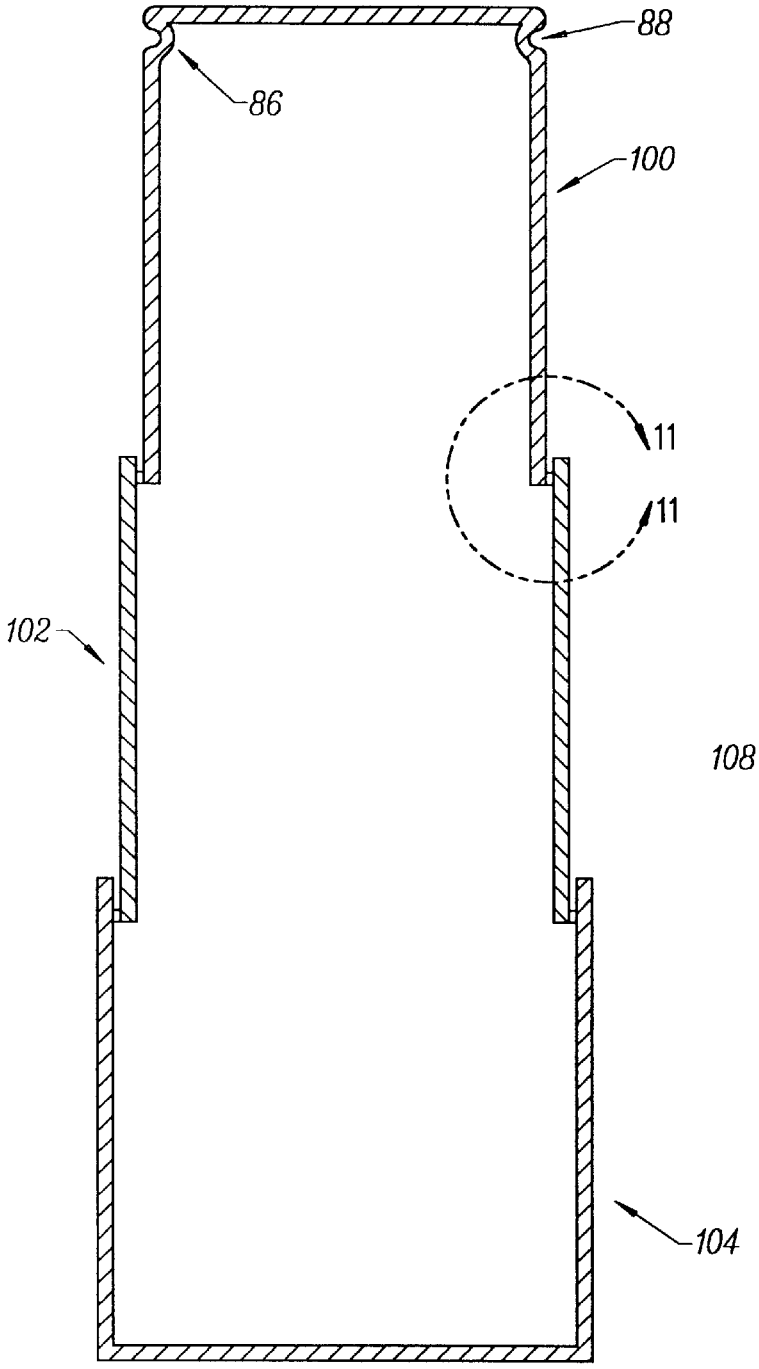
FIG. 10 is a side elevational view showing the full extension of the system of FIG. 9 of the present invention.
Figure 11:
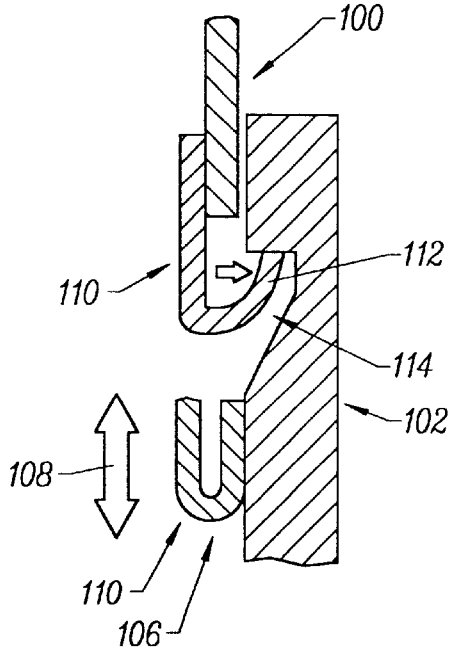
FIG. 11 is a sectional view depicting a typical structure for the telescoping sections of the embodiment depicted in FIGS. 9 and 10.

With reference to FIGS. 9–11, yet another embodiment 10B of the system of the present invention is shown in which the rocket carrying skirt 100 is telescopically movable relative to intermediate section 102 and outer container 104. FIG. 10 shows the extended relationship of these elements due to the pressure which is generated within system 10B, more fully discussed with respect to system 10. FIG. 11 represents a locking or latching mechanism 106. As skirt 100 moves relative to intermediate section 102, directional arrow 108, latch 110 comes into play. Latch 110 includes a movable arm 112 which pivots into a recess 114 formed on the inner portion of intermediate section 102. As shown in FIG. 11, latch 110 only becomes activated when recess 114 permits arm 112 to expand and engage intermediate section 102. Latch 110 may take the form of one of many latches of similar construction around the periphery of intermediate section 102 which are fastened to skirt 100 by welding, by integral formation, through the use of fasteners, and the like.

In operation, rocket 28 is mounted to platform 24. Platform 24 is within container 12 at level depicted as level 82 in FIG. 4. The rocket is then ignited and the exhaust gases from rocket 28 enter chamber 20 directly or through housing 38 and plurality of doors 52. Fluid pressure on second side 27 causes platform 24 to rise relative to bottom 14 of container 12, terminating in a position shown in solid line in FIG. 1 and noted as level 84 in FIG. 4. At that point, rocket 28 will possess a velocity due to the movement of platform 24. The rocket 28 will then continue above platform 24 and into its flight condition. It should be noted that a ground effect will also occur above platform 24 for a specific period of time after rocket 28 leaves platform 24. Relief valves 86 and 88 as well as slits or grates further control the rate of rise and fall of platform 24.

With respect to embodiment 10A shown in FIGS. 5–8, rocket 28 is moved upwardly by expanding gases 116 within chamber 118 formed by skirt 92 and container 94. As rocket 28 moves upwardly, the relief valves 86 and 88 come into play, permitting a portion of the pressure within chamber 18 to be released. This may be considered to be a second stage, FIG. 6, when compared to the position of rocket 28 in FIG. 5. Finally, a third stage is reached in which relief valves 86 and 88 are employed and plurality of vents 96 are also used to release the pressure within chamber 118. FIG. 7 shows this stage of movement of rocket 28 upwardly. Again, at this point, rocket 28 lifts from platform and moves upwardly into space. Skirt 92 will then settle into the position shown in FIG. 5 by the release of pressure through relief valves 86 and 88 and vents 96. The proper sizing of relief valves 86 and 88, as well as vents 96, will preclude the use of any stop mechanisms in the embodiment 10A depicted in FIGS. 5–8.

FIGS. 9–11 show a telescoping version 10B of the system of the present invention in which a skirt 100, having relief valves 86 and 88, moves upwardly under the pressure of steam within chamber 120. The rocket exhaust and steam generation lines are not depicted in FIGS. 9–11 for the sake of simplicity. Moreover, vents, such as vents 96 of FIGS. 5–8, may be found in either skirt 100 or intermediate portion 102. Skirt 100 latches to intermediate portion 102 by the use of latching means 106, FIG. 11. Following the launch of rocket 28, the extended configuration of system 10B shown in FIG. 10 will revert to that shown in FIG. 9, without the use of any stop mechanisms.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A velocity booster system for a rocket, comprising:

a. a container having a bottom and a side wall portion extending outwardly from said bottom and terminating in a peripheral edge forming a chamber, said chamber further including an opening formed at said peripheral edge;

b. a platform having a first surface for supporting the rocket and a second surface facing said chamber, said platform movable along said container side wall portion between said bottom of said container and said peripheral edge of said side wall portion of said container;

c. support means for holding said platform at a predetermined level above said bottom of said container; and d. conduit means for directing exhaust material from the rocket to said chamber of said container between said second surface of said platform and said bottom of said container to produce a fluid pressure on said second surface of the platform, said conduit means further comprising a housing connected to said platform, said housing including an opening communicating with the exhaust material of the rocket, said housing further comprising at least one door opened by the exhaust material from the rocket, allowing exhaust material to enter said chamber of said container.

2. A velocity booster system for a rocket, comprising:

a. a container having a bottom and a side wall portion extending outwardly from said bottom and terminating in a peripheral edge forming a chamber, said chamber further including an opening formed at said peripheral edge;

b. a platform having a first surface for supporting the rocket and a second surface facing said chamber, said platform movable along said container side wall portion between said bottom of said container and said peripheral edge of said side wall portion of said container, said platform further including a rim portion extending toward the bottom of said chamber, said rim portion contacting said bottom of said container;

c. support means for holding said platform at a predetermined level above said bottom of said container; and d. conduit means for directing exhaust material from the rocket to said chamber of said container between said second surface of said platform and said bottom of said container to produce a fluid pressure on said second surface of the platform.

3. The system of claim 2 in which said side portion of said platform includes a first part and a second part telescopically movable relative to said first part.

4. The system of claim 1 which additionally comprises a liquid located in said chamber, the rocket exhaust gases heating said liquid in said chamber to produce steam.

5. The system of claim 4 which additionally comprises a preheater for said liquid in said chamber.

6. The system of claim 4 which additionally comprises a heat source separate from the rocket exhaust to elevate the temperature of said liquid in said chamber.

7. The system of claim 1 which additionally comprises vent means for relieving fluid pressure from said chamber.

8. The system of claim 2 in which said conduit means comprises a housing connected to said platform, said housing including an opening communicating with the exhaust material of the rocket, said housing further comprising at least one door opened by the exhaust material from the rocket, allowing exhaust material to enter said chamber of said container.

9. The system of claim 8 in which said platform further includes a rim portion extending toward the bottom of said chamber, said rim portion contacting said bottom of said container.

10. The system of claim 9 in which said side portion of said platform includes a first part and a second part telescopically movable relative to said first part.

11. The system of claim 10 which additionally comprises a liquid located in said chamber, the rocket exhaust gases heating said liquid in said chamber to produce steam.

12. The system of claim 11 which additionally comprises a preheater for said liquid in said chamber.

13. The system of claim 12 which additionally comprises a heat source separate from the rocket exhaust to elevate the temperature of said liquid in said chamber.

14. A velocity booster system for a rocket, comprising:

a. a container having a bottom and a side wall portion extending outwardly from said bottom and terminating in a peripheral edge forming a chamber, said chamber further including an opening formed at said peripheral edge;

b. a platform having a first surface for supporting the rocket and a second surface facing said chamber, said platform movable along said container side wall portion between said bottom of said container and said peripheral edge of said side wall portion of said container;

c. support means for holding said platform at a predetermined level above said bottom of said container;

d. conduit means for directing exhaust material from the rocket to said chamber of said container between said second surface of said platform and said bottom of said container to produce a fluid pressure on said second surface of the platform; and e. a stop for launching the travel of said platform relative to said peripheral edge.

* * * * *